US010839759B2

(12) United States Patent
Lin

(10) Patent No.: US 10,839,759 B2
(45) Date of Patent: Nov. 17, 2020

(54) SIGNAL PROCESSING METHOD AND DISPLAY DEVICE

(71) Applicant: AU Optronics Corporation, Hsin-Chu (TW)

(72) Inventor: Hui-Feng Lin, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/891,189

(22) Filed: Jun. 3, 2020

(65) Prior Publication Data

US 2020/0294455 A1 Sep. 17, 2020

Related U.S. Application Data

(62) Division of application No. 16/121,912, filed on Sep. 5, 2018, now Pat. No. 10,714,025.

(30) Foreign Application Priority Data

Jan. 12, 2018 (TW) ..... 107101313 A

(51) Int. Cl.
*G09G 3/34* (2006.01)
*G09G 3/36* (2006.01)

(52) U.S. Cl.
CPC ..... *G09G 3/3406* (2013.01); *G09G 3/3426* (2013.01); *G09G 3/3607* (2013.01); *G09G 3/3648* (2013.01); *G09G 2320/0242* (2013.01); *G09G 2320/0276* (2013.01); *G09G 2320/062* (2013.01); *G09G 2320/066* (2013.01); *G09G 2320/0646* (2013.01); *G09G 2320/0666* (2013.01); *G09G 2320/0673* (2013.01); *G09G 2320/0686* (2013.01); *G09G 2360/16* (2013.01)

(58) Field of Classification Search
CPC ..... G09G 3/3406; G09G 3/3607; G09G 2360/16; G09G 2320/0242; G09G 2320/0666; G09G 2320/0673; G09G 2320/0646
See application file for complete search history.

(56) References Cited

U.S. PATENT DOCUMENTS 9,286,857 B2 * 3/2016 Lin ..... G09G 5/02
2005/0231534 A1 * 10/2005 Lee ..... G09G 3/2003 345/690
2006/0139527 A1 * 6/2006 Chang ..... G09G 3/3648 349/114
2006/0214904 A1 * 9/2006 Kimura ..... G09G 3/342 345/102

(Continued)

*Primary Examiner* — William Lu
(74) *Attorney, Agent, or Firm* — WPAT, PC

(57) ABSTRACT

A signal processing method and a display device are disclosed herein. The method includes the following operations: adjusting an initial backlight value to generate a first backlight value according to subarea classification information of a display area; generating a backlight adjustment value according to a white pixel ratio of the display area; adjusting the first backlight value to generate a second backlight value according to the backlight adjustment value; and generating a plurality of ultimate gray values according to the second backlight value. The second backlight value is for controlling a backlight module of a display device, and the ultimate gray value is for controlling a liquid crystal unit of the display device.

2 Claims, 10 Drawing Sheets

(56) References Cited

U.S. PATENT DOCUMENTS

2006/0284805 A1* 12/2006 Baek, II ..... G09G 3/3607 345/88
2007/0165960 A1* 7/2007 Yamada ..... H04N 9/735 382/254
2007/0279372 A1* 12/2007 Brown Elliott ..... G09G 3/3607 345/102
2008/0253445 A1* 10/2008 Hekstra ..... H04N 9/3114 375/240.01
2009/0135207 A1* 5/2009 Tseng ..... G09G 3/3607 345/690
2009/0201309 A1* 8/2009 Demos ..... G01J 3/50 345/589
2009/0207182 A1* 8/2009 Takada ..... G09G 3/3607 345/589
2009/0231467 A1* 9/2009 Yamashita ..... H04N 5/238 348/234
2010/0103187 A1* 4/2010 Linssen ..... G09G 3/2003 345/590
2011/0267379 A1* 11/2011 Kurabayashi ..... G09G 3/3426 345/690
2012/0224365 A1* 9/2012 Yanai ..... G09G 3/06 362/231
2013/0286271 A1* 10/2013 Ishii ..... G09G 3/3406 348/333.01
2014/0085170 A1* 3/2014 Park ..... G09G 5/02 345/83
2014/0270699 A1* 9/2014 Casey ..... H04N 21/2393 386/241

* cited by examiner

| | | | |
|---|---|---|---|
| 50 | A 100 | B 100 | 0 |
| 50 | C 100 | D 98 | 0 |

↓

| | | | |
|---|---|---|---|
| 50 | A 100 | B 80 | 0 |
| 50 | C 100 | D 78 | 0 |

| | | | |
|---|---|---|---|
| 50 | A 100 | B 100 | 0 |
| 50 | C 100 | D 98 | 0 |

↓

| | | | |
|---|---|---|---|
| 50 | A 100 | B 100 | 0 |
| 50 | C 100 | D 78 | 0 |

SIGNAL PROCESSING METHOD AND DISPLAY DEVICE

BACKGROUND

Technical Field

The present disclosure relates to a signal processing method and a display device, and in particular, to a method for converting a red, green, blue (RGB) gray value into a red, green, blue, white (RGBW) gray value and a display device utilizing the same.

Related Art

With rapid development of display technology, people will use large or small liquid crystal displays (LCDs) anywhere at any time, for examples, televisions, smart phones, tablet computers, and computers. Since white sub-pixels are added to an RGBW LCD, the RGBW LCD has a higher transmittance compared with an RGB LCD, and therefore, has advantages of low power consumption and enhanced panel luminance.

However, an RGBW LCD has disadvantages of being a little dark when displaying a single color and being too bright when displaying white only, and has more light leakage compared with an RGB LCD with the same specification when displaying a dark state due to the higher transmittance in white sub-pixels, resulting in reducing contrast ratio, thereby influencing display quality. Therefore, how to enhance a contrast ratio of an image without increasing power consumption of an LCD is a problem to be solved in the field.

SUMMARY

The first aspect of the embodiment in the present invention is to provide a signal processing method. The method comprises the following steps: adjusting an initial backlight value to generate a first backlight value according to subarea classification information of a display area; generating a backlight adjustment value according to a white pixel ratio of the display area; adjusting the first backlight value to generate a second backlight value according to the backlight adjustment value; and generating a plurality of ultimate gray values according to the second backlight value; wherein the second backlight value is for controlling a backlight module of a display device, and the ultimate gray values are for controlling the liquid crystal unit of the display device.

A second aspect of the embodiment in the present invention is to provide a signal processing method. The method comprises the following steps: receiving an input image, wherein the input image comprises at least one display area, the at least one display area comprises N pixels, N is a positive integer, the N pixels have M pixels corresponding to white, and M is a positive integer and is smaller than N; and adjusting a first backlight value of the at least one display area selectively to generate a second backlight value according to M/N, wherein the second backlight value is adjusted to be smaller than the first backlight value when M/N is larger than a critical value, and the second backlight value is equal to the first backlight value when M/N is equal to or smaller than the critical value; wherein the second backlight value is for controlling a backlight module of a display device.

A third aspect of the embodiment in the present invention is to provide a display device, which comprises: a backlight module, a liquid crystal unit, and a processor. The processor is coupled to the backlight module and the liquid crystal unit and for receiving an input image, and controlling the backlight module and the liquid crystal unit according to the input image; wherein the input image comprises at least one display area, the at least one display area comprises N pixels, N is a positive integer, the N pixels have M pixels corresponding to white, and M is a positive integer and is smaller than N; wherein when M/N is larger than a critical value, the processor down-regulates a first backlight value of the at least one display area to generate a second backlight value; wherein the second backlight value is used to control the backlight module.

A fourth aspect of the embodiment in the present invention is to provide a display device, comprising: a backlight module, a liquid crystal unit, and a processor. The liquid crystal unit is for displaying an output image. The processor is coupled to the backlight module and the liquid crystal unit, and for receiving an input image and controlling the backlight module and the liquid crystal unit according to the input image; wherein a plurality of subarea images is defined for the input image and the output image respectively, and each of the subarea images respectively has A pixels; wherein when a trichromatic gray value of A pixels of a first subarea image of the input image is [255, 255, 255], the A pixels of the first subarea image of the output image have a tetrachromatic gray value [255, 255, 255, 255]; wherein when a trichromatic gray value of B pixels of a second subarea image of the input image is [245, 10, 3], a trichromatic gray value of the (A-B) pixels of the second subarea image of the input image is [255, 255, 255], and when a percentage value of B and A is larger than 15%, a tetrachromatic gray value of the B pixels of the second subarea image of the output image is [245, 10, 2, 2] and a tetrachromatic gray value of the (A-B) pixels of the second subarea image of the output image is [186, 186, 186, 186]; wherein when a trichromatic gray value of C pixels of a third subarea image of the input image is [245, 10, 3], a trichromatic gray value of the (A-C) pixels of the third subarea image of the input image is [255, 255, 255], and when a percentage value of C and A is smaller than 15%, a tetrachromatic gray value of the C pixels of the third subarea image of the output image is [255, 2, 0, 0] and a tetrachromatic gray values of the (A-C) pixels of the third subarea image of the output image is [208, 208, 208, 235]; and wherein when a trichromatic gray value of A pixels of a fourth subarea image of the input image is [0, 0, 0], a tetrachromatic gray value of the A pixels of the fourth subarea image of the output image is [0, 0, 0, 0].

BRIEF DESCRIPTION OF THE DRAWINGS

In order to make the aforementioned and other objectives, features, advantages, and embodiments of the present invention be more comprehensible, the accompanying drawings are described as follows.

DETAILED DESCRIPTION

The following disclosure provides a lot of different embodiments or examples to implement different features of the present invention. The elements and configurations in specific examples are used to simplify the disclosure in the following discussion. Any example to be discussed is only for explanation and will not limit the scope and meaning of the present invention or examples thereof in any manner. Furthermore, the present disclosure may refer to numbers, symbols, and/or letters repeatedly in different examples, and the repeated references are all for simplification and explanation, but do not specify the relationship between different embodiments and/or configurations in the following discussion.

Unless otherwise specified, all the terms used in the whole specification and claims generally have the same meaning as is commonly understood by persons skilled in the art in the field, in the disclosed content, and the specific content. Some terms used for describing the present disclosure will be discussed below or in other parts of this specification, so as to provide additional guidance for persons skilled in the art in addition to the description of the disclosure.

As used herein, "coupling" or "connecting" may mean that two or more elements are either in direct physical or electrical contact, or in indirect physical or electrical contact. Furthermore, "coupling" or "connecting" may further mean two or more elements co-operate or interact with each other.

In the present invention, it is comprehensible that terms such as first, second, and third are used to describe various elements, components, areas, layers and/or blocks. However, the elements, components, areas, layers and/or blocks should not be limited by the terms. The terms are only used for identifying signal element, component, area, layer and/or block. Therefore, the following first element, component, area, layer and/or block may also be called as the second element, component, area, layer and/or block without departing from the intention of the present invention. The term "and/or" herein contains any combination of one or more of correlated objects that are listed. The term "and/or" in the documents of the present invention refers to any combination of one, all, or at least one of the listed elements.

Figure 1:
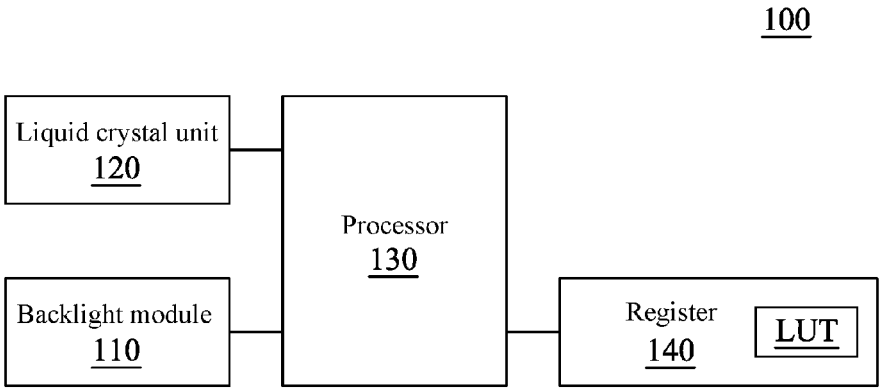
FIG. 1 is a schematic view of a display device according to some embodiments of the present invention.
Figure 2:
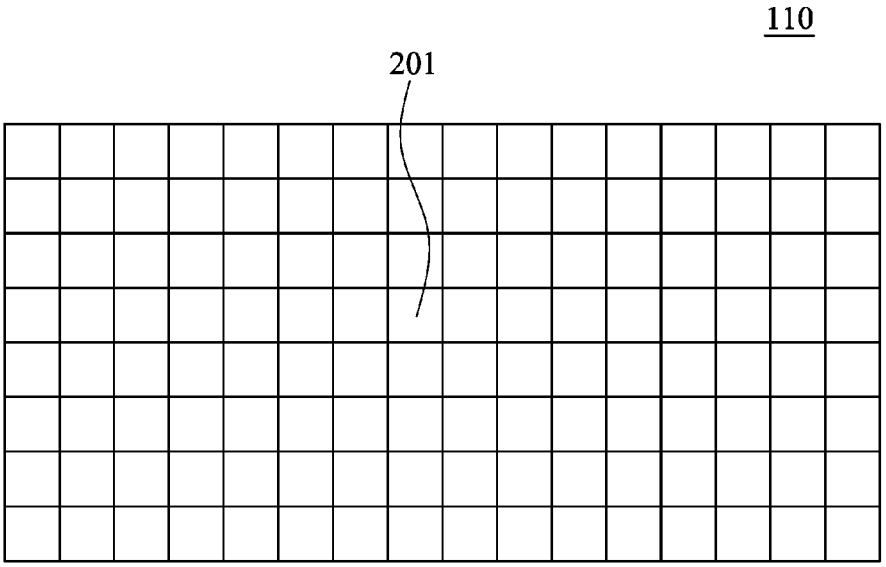
FIG. 2 is a schematic view of a backlight module according to some embodiments of the present invention.

Referring to FIG. 1 and FIG. 2, FIG. 1 is a schematic view of a display device 100 according to some embodiments of the present invention, and FIG. 2 is a schematic view of a backlight module 110 according to some embodiments of the present invention. As shown in FIG. 1, the display device 100 comprises a backlight module 110, a liquid crystal unit 120, a processor 130, and a register 140. The liquid crystal unit 120 is configured to display an output image, the processor 130 is coupled to the backlight module 110, the liquid crystal unit 120, and the register 140, the processor 130 is configured to receive an input image, so as to control the backlight module 110 and the liquid crystal unit 120 according to the input image, and the register 140 stores multiple look up tables (LUTs) and provides the same to the processor 130 for use. As shown in FIG. 2, the backlight module 110 has dynamic backlight areas 201 in 16 rows and 8 columns, that is, 128 dynamic backlight areas 201, and each of the dynamic backlight areas 201 has n pixels. For examples, if the resolution of the display device 100 is 1920*1080, n=(1920*1080)/(16*8)=16200, and in the embodiments of the present invention, n is 25 for example. Each pixel has 4 sub-pixels, that is, red, green, blue, and white sub-pixels. However, the signal processing method and the display device in the present invention are not limited thereby, and any number of areas and pixels and any arrangement manner of sub-pixels are all applicable to the present invention.

Figure 3:
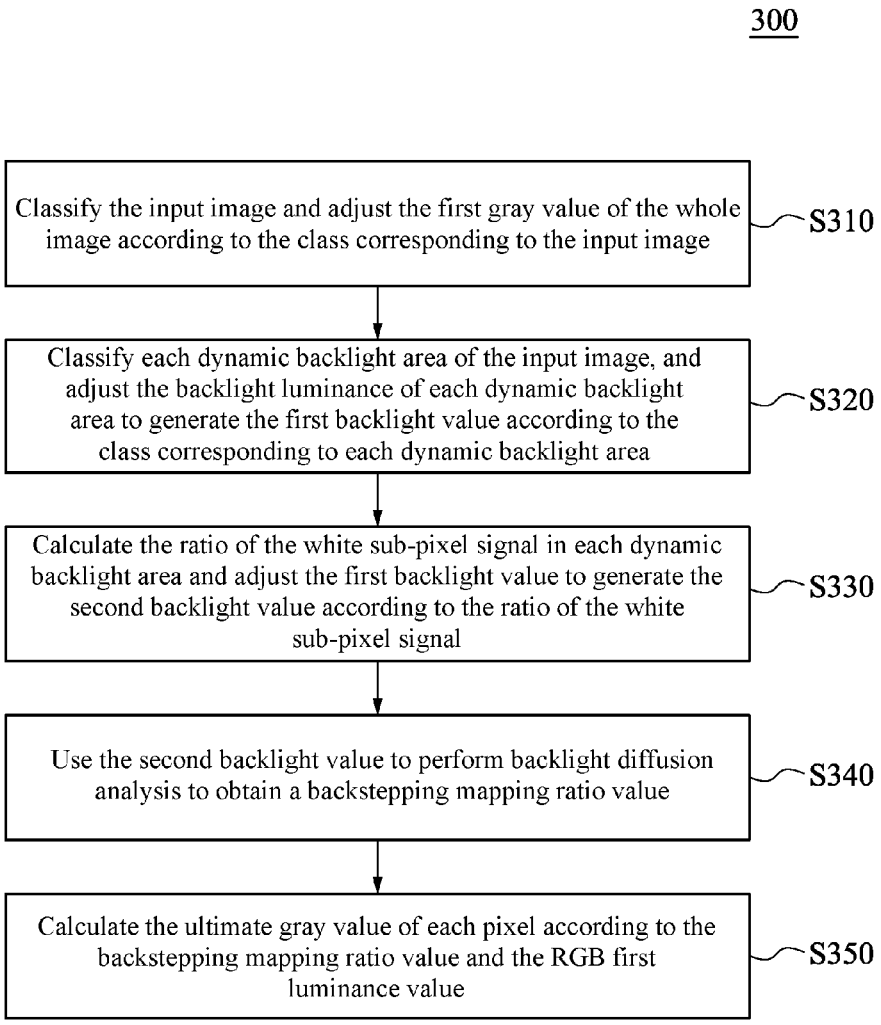
FIG. 3 is a flow chart of a signal processing method according to some embodiments of the present invention.

Referring to FIGS. 1-3 together, FIG. 3 is a flow chart of a signal processing method 300 according to some embodiments of the present invention. The signal processing method 300 in the first embodiment of the present invention converts an RGB signal into an RGBW signal, and dynamically adjusts the backlight luminance to achieve better display effects. The following gray values are in a range of 0 and 255, a backlight working cycle is in a range of 0% and 100% (that is, the backlight value), and the backlight luminance is in proportion to the backlight working cycle. In one embodiment, the signal processing method 300 in FIG. 3 can be applied in the display device 100 in FIGS. 1 and 2, and the processor 130 is configured to adjust the backlight values adopted by the backlight module 110 and the liquid crystal unit 120 and the RGB signal according to the steps described in the signal processing method 300. As shown in FIG. 3, the signal processing method 300 comprises the following steps:

Step S310: classifying the input image and adjusting the first gray value of the whole image according to the class corresponding to the input image;

Step S320: classifying each dynamic backlight area of the input image, and adjusting the backlight luminance of each dynamic backlight area to generate the first backlight value according to the class corresponding to each dynamic backlight area;

Step S330: calculating the ratio of the white sub-pixel signal in each dynamic backlight area and adjusting the first backlight value to generate the second backlight value according to the ratio of the white sub-pixel signal;

Step S340: using the second backlight value to perform backlight diffusion analysis to obtain a backstepping mapping ratio value $\alpha'$; and Step S350: calculating the ultimate gray value of each pixel according to the backstepping mapping ratio value $\alpha'$ and the RGB first luminance value.

In order to make the signal processing method 300 in the first embodiment of the present invention be comprehensible, FIGS. 1-12 may be referred to together.

Figure 4:
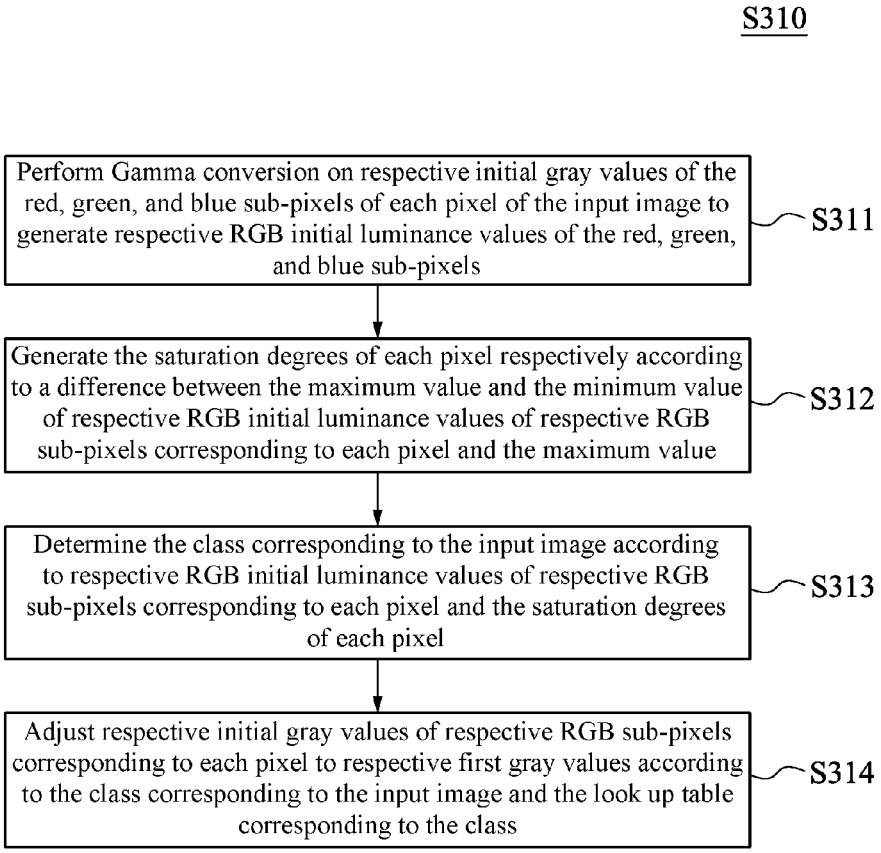
FIG. 4 is a flow chart of Step S310 according to some embodiments of the present invention.

In Step S310, the input image is classified and the first gray value of the whole image is adjusted according to the class corresponding to the input image. Referring to FIG. 4, FIG. 4 is a flow chart of Step S310 according to some embodiments of the present invention. As shown in FIG. 4, Step S310 comprises the following steps:

Step S311: performing Gamma conversion on respective initial gray values of the red, green, and blue sub-pixels of each pixel of the input image to generate respective RGB initial luminance values of the red, green, and blue sub-pixels;

Step S312: generating the saturation degrees of each pixel respectively according to a difference between the maximum value and the minimum value of respective RGB initial luminance values of respective RGB sub-pixels corresponding to each pixel and the maximum value;

Step S313: determining the class corresponding to the input image according to respective RGB initial luminance values of respective RGB sub-pixels corresponding to each pixel and the saturation degrees of each pixel; and Step S314: adjusting respective initial gray values of respective RGB sub-pixels corresponding to each pixel to respective first gray values according to the class corresponding to the input image and the look up table corresponding to the class.

For example, the initial gray value of the red, green, and blue sub-pixels of the pixel P1 in the input image is (R, G, B)=(255, 0, 0), and the initial gray value of the red, green, and blue sub-pixels of the pixel P2 is (R, G, B)=(255, 255, 255). At first, in Step S311, the pixels P1 and P2 will experience Gamma conversion according to Formula 1, and the gray value is converted from a signal domain to a luminance domain, so that the signal of the gray value can match the backlight luminance. Respective RGB initial luminance values of the pixels P1 and P2 that are in a range of 0 and 1 will be obtained after conversion. In this example, the RGB initial luminance values of the pixel P1 are [R, G, B]=[1, 0, 0], and the RGB initial luminance values of the pixel P2 are [R, G, B]=[1, 1, 1]. The other pixels of the input image are all processed with reference to the pixels P1 and P2, and the initial gray values (R, G, B) of each sub-pixel are converted to the initial luminance values [R, G, B] according to Formula 1, wherein the Formula 1 is provided as follows:

$$[R, G, B] = \left(\frac{(R, G, B)}{255}\right)^{2.2} \quad \text{Formula 1}$$

Next, in Step S312, the maximum luminance value Vmax=1 and the minimum luminance value Vmin=0 of the pixel P1 [1, 0, 0] are used to obtain the saturation degree S1=1 of the pixel P1 according to Formula 2. In a similar way, the maximum luminance of the pixel P2 [1, 1, 1] is Vmax=1, and the minimum luminance value is Vmin=1, and the saturation degree of the pixel P2 is S2=0 according to Formula 2. The other pixels of the input image all can be processed with reference to the pixels P1 and P2, the maximum luminance Vmax and the minimum luminance value Vmin corresponding to one pixel are used to obtain the saturation degree S according to Formula 2, and Formula 2 is described as follows:

$$S = \frac{V_{max} - V_{min}}{V_{max}}. \quad \text{Formula 2}$$

Next, in Step S313, the input image is classified according to the initial luminance values and the saturation degree of the pixel of the input image. In detail, the classification is performed with reference to the numbers of the pixels satisfying various saturation degrees by taking the saturation degree as a limitation. There are two main thresholds of the number of pixels, one is a pixel threshold value $TH_{pixel}$, and the other is a pixel chrominance threshold value $TH_{color\ pixel}$. In the embodiments of the present invention, the pixel threshold value $TH_{pixel}$=(the total number of the pixels of the input image)*60%, and the pixel chrominance threshold value $TH_{color\ pixel}$=(the total number of the pixels of the input image)*10%.

Class 1: the input frame is a pantone (a pure color picture) or a test picture. When the saturation degree of the input image satisfies the condition that the number of the pixels is larger than the pixel threshold value $TH_{pixel}$ in Formula 3, the input image is classified as Class 1. For example, the total number of the pixels of the input image is 100, wherein the saturation degree of 61 pixels is 1, and then, the input image is classified as Class 1. Formula 3 is described as follows:

$$S=1 \text{ or } S=0$$

(S represents a saturation degree) Formula 3.

Class 2: the input frame is a high contrast image on a mainly black background. When the initial luminance value and the saturation degree of the input image satisfy the condition that the number of the pixels is larger than the pixel threshold value $TH_{pixel}$ in Formula 4, the input image is classified as Class 2. For example, the total number of the pixels of the input image is 100, wherein the initial luminance values of 61 pixels are all in a range of 0-0.05 and the saturation degrees are all in a range of 0-1, and then, the input image is classified as Class 2. Formula 4 is described as follows.

$$0 \le S \le 1 \text{ and } 0 \le V \le 0.05$$

(V represents a luminance value) Formula 4.

Class 3: the input frame is a common image with contrast enhancement. When the initial luminance value and the saturation degree of the input image satisfy the condition that the number of the pixels is larger than the chrominance threshold value $TH_{color\ pixel}$ in Formula 5, or the initial luminance value and the saturation degree of the pixels of the input image satisfy the condition that the number of the pixels is larger than the chrominance threshold value $TH_{color\ pixel}$ in Formula 6, the input image is classified as Class 3. For example, the total number of the pixels of the input image is 100, wherein the initial luminance value and the saturation degree of 11 pixels satisfy Formula 5 or 6, and then, the input image is classified as Class 3. Formula 5 and Formula 6 are described as follows:

$$S>0.8 \text{ and } V>0.8 \quad \text{Formula 5}$$

$$S<0.4 \text{ and } V>0.6 \quad \text{Formula 6}$$

Class 4: the input frame mostly has a low saturation degree (for example, a map). When the initial luminance value and the saturation degree of the input image satisfy the condition that the number of the pixels is smaller than the pixel chrominance threshold value $TH_{color\ pixel}$ in Formula 5 and the initial luminance value and the saturation degree of the pixels of the input image satisfy the condition that the number of the pixels is larger than the pixel chrominance threshold value $TH_{color\ pixel}$ in Formula 6, the input image is classified as Class 4. For example, the total number of pixels of the input image is 100, wherein the initial luminance value and the saturation degree of 9 pixels satisfy Formula 5 and the initial luminance value and the saturation degree of 11 pixels satisfy Formula 6, and then, the input image is classified as Class 4.

Class 5: when the saturation degrees of the pixels of the input image all do not satisfy the input image in Classes 1-4, the input image is classified as Class 5.

Next, in Step S314, according to the class (Classes 1-5) corresponding to the input image and the look up table corresponding to the class, respective RGB initial gray values (R, G, B) of the sub-pixels of each pixel are adjusted as respective RGB first gray values (Rf, Gf, Bf) of the sub-pixels.

After the calculation in Step S310, since the whole image has been adjusted, the white washing phenomenon (low contrast) of an RGBW LCD can be alleviated.

Figure 5:
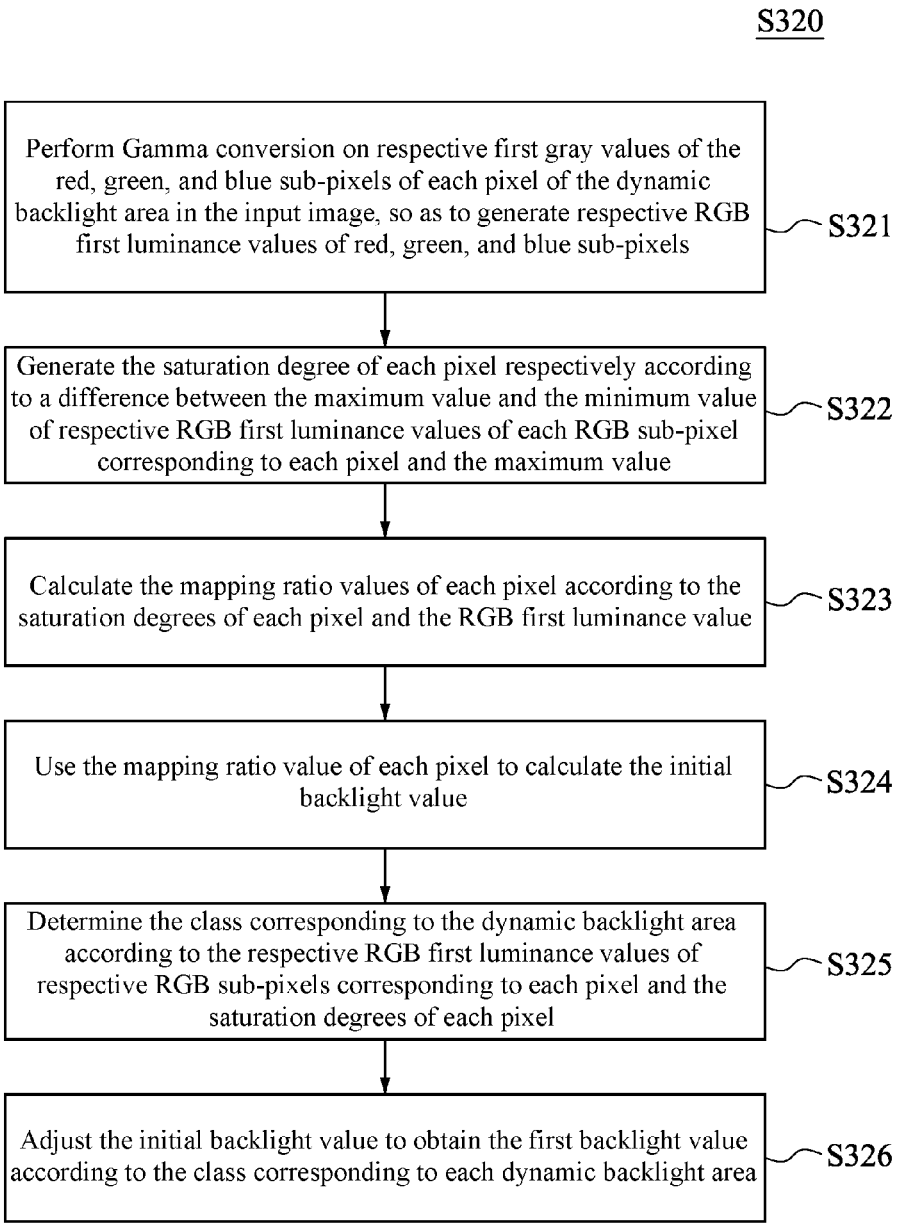
FIG. 5 is a flow chart of Step S320 according to some embodiments of the present invention.

In Step S320, each dynamic backlight area of the input image is classified, and the backlight luminance of each dynamic backlight area is adjusted according to the classes corresponding to each dynamic backlight area to generate the first backlight value. Referring to FIG. 5, FIG. 5 is a flow chart of step S320 according to some embodiments of the present invention. In Step S310, the first gray value is adjusted for the whole input image, and in Step S320, respective dynamic backlight areas in the input image are processed respectively. For convenient description, one dynamic backlight area 201 of the backlight module 110 is taken as an example, and the implementation steps of the other dynamic backlight areas 201 are all the same. As shown in FIG. 5, Step S320 comprises the following steps:

Step S321: performing Gamma conversion on respective first gray values of the red, green, and blue sub-pixels of each pixel corresponding to the dynamic backlight area 201 in the input image, so as to generate respective RGB first luminance values [Rf, Gf, Bf] of red, green, and blue sub-pixels;

Step S322: generating the saturation degree of each pixel respectively according to a difference between the maximum value and the minimum value of respective RGB first luminance values [Rf, Gf, Bf] of each RGB sub-pixel corresponding to each pixel and the maximum value Step S323: calculating the mapping ratio values (mapping ratio) α of each pixel according to the saturation degrees of each pixel calculated in Step S322 and the RGB first luminance value [Rf, Gf, Bf];

Step S324: using the mapping ratio value α of each pixel to calculate the initial backlight value;

Step S325: determining the class corresponding to the dynamic backlight area 201 according to the respective RGB first luminance values [Rf, Gf, Bf] of respective RGB sub-pixels corresponding to each pixel and the saturation degrees of each pixel; and Step S326: adjusting the initial backlight value to obtain the first backlight value according to the class corresponding to each dynamic backlight area 201.

Figure 6:
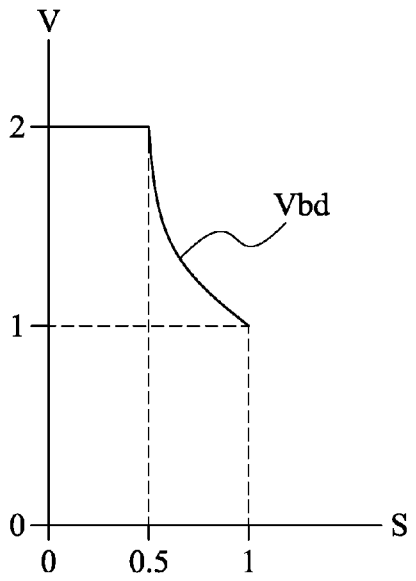
FIG. 6 is a relation diagram of the ranges of color gamut of RGBW according to some embodiments of the present invention.

The calculation manners in Steps S321 and S322 are the same as the calculation manners in Steps S311 and S312, and will not be repeated herein. Next, the calculation manner in Step 323 is described. Referring to FIG. 6, FIG. 6 is a relation diagram of the ranges of color gamut of RGBW according to some embodiments of the present invention, wherein the horizontal axis represents the saturation degree S, and the longitudinal axis represents the luminance value V. As shown in FIG. 6, it can be understood that when the saturation degree S falls in a range of 0-0.5, the luminance boundary value Vbd is a fixed value 2; when the saturation degree S is larger than 0.5, the luminance boundary value Vbd is then decreased. Therefore, the relation between the saturation degree S and the luminance boundary value Vbd is shown in Formula 7. In the present embodiment, the mapping ratio value α is a multiple that needs to be multiplied by the RGB signal when the RGB signal is expanded to the RGBW signal. As described above, the saturation degree of the exemplary pixel P1 is S1=1, and the saturation degree of the pixel P2 is S2=0. Therefore, the luminance boundary value corresponding to the pixel P1 is Vbd=1, and the luminance boundary value of the pixel P2 is 2. Then, the luminance boundary value Vbd and the maximum value of the RGB first luminance value [Rf, Gf, Bf] are used to obtain the mapping ratio value α, wherein the calculation manner of the mapping ratio value α is as shown in Formula 8. Therefore, in the example, the mapping ratio value of the pixel P1 is α1=1 (Vmax=1), and the mapping ratio value of the pixel P2 is α2=2 (Vmax=1). In the embodiment of the present invention, Formula 7 and Formula 8 are described as follows:

$$\begin{cases} S < 0.5,\ Vbd = 2 \\ S \geq 0.5,\ Vbd = \dfrac{1}{S} \end{cases}; \qquad \text{Formula 7}$$

$$\alpha = \frac{Vbd}{V_{max}}. \qquad \text{Formula 8}$$

Then, the calculation manner of Step 324 is described. After the mapping ratio values α of each pixel are found, the minimum mapping ratio value $\alpha_{min}$ in the dynamic backlight area 201 is selected as the initial backlight value (BL_duty) of the dynamic backlight area 201. In the example, each dynamic backlight area 201 is corresponding to 25 pixels. Therefore, the mapping ratio value $\alpha_{min}$ is selected from the respective mapping ratio values α of the 25 pixels. Herein, for example, the mapping ratio value α1=1 of the pixel P1 serves as the minimum mapping ratio value $\alpha_{min}$, and the calculation manner of the initial backlight value BL_duty of the corresponding dynamic backlight area is shown in Formula 9, and Formula 9 is described as follows:

$$\text{BL_duty} = \frac{1}{\alpha_{min}} \qquad \text{Formula 9}$$

The calculation manner in Step S325 is the same as the calculation manner in Step S313, and will not be repeated herein. Next, the calculation manner of Step S326 is described. After the initial backlight value BL_duty of each dynamic backlight area 201 is obtained in step S324, the initial backlight value is adjusted according to the gamma curve corresponding to the class of each dynamic backlight area 201. For example, if the initial backlight value BL_duty is 90%, the backlight luminance value corresponding to 90% is V=1*90%=0.9, and the corresponding look up table of classes is used to look for the new backlight value corresponding to the backlight luminance value 0.9, that is, the backlight value is the first backlight value BL_first.

Figure 7:
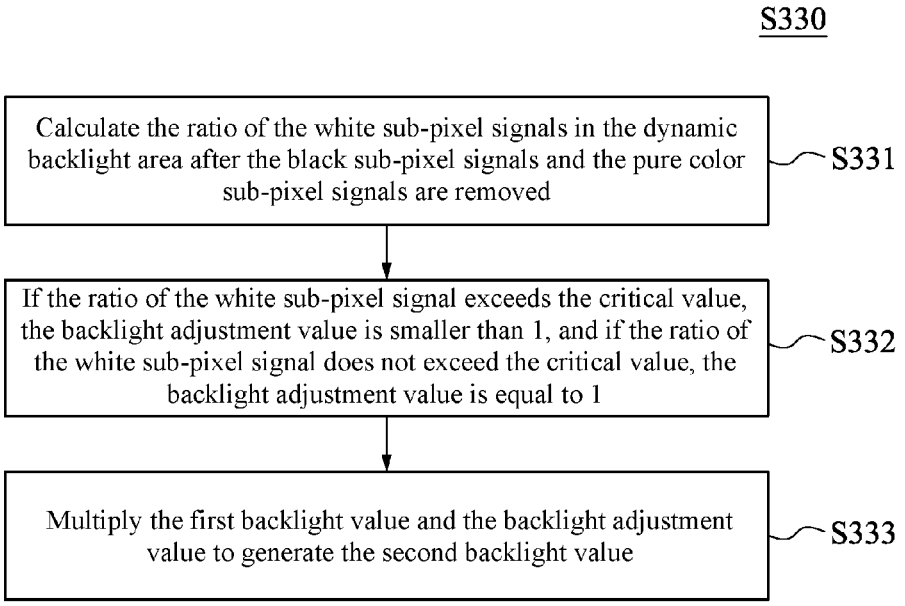
FIG. 7 is a flow chart of Step S330 according to some embodiments of the present invention.

In Step S330, the ratio of the white sub-pixel signal in the dynamic backlight area is calculated, the first backlight value is adjusted according to the ratio of the white sub-pixel signal to generate the second backlight value. Referring to FIG. 7, FIG. 7 is a flow chart of step S330 according to some embodiments of the present invention. As shown in FIG. 7, Step S330 comprises the following steps:

Step S331: calculating the ratio of the white sub-pixel signals in the dynamic backlight area 201 after the black sub-pixel signals and the pure color sub-pixel signals are removed;

Step S332: if the ratio of the white sub-pixel signal exceeds the critical value, the backlight adjustment value is smaller than 1, and if the ratio of the white sub-pixel signal does not exceed the critical value, the backlight adjustment value is equal to 1; and Step S333: multiplying the first backlight value and the backlight adjustment value to generate the second backlight value.

Figures 8A, 8B:
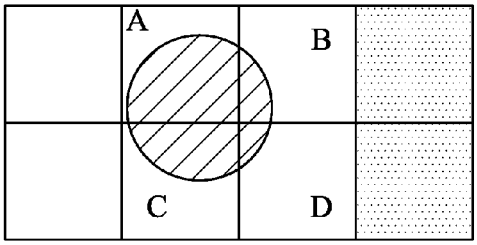
FIG. 8A is a schematic view of an input image according to some embodiments of the present invention.
FIG. 8B is a schematic view of a backlight value of an input image according to FIG. 8A.

For example, referring to FIG. 8A and FIG. 8B, FIG. 8A is a schematic view of an input image according to some embodiments of the present invention, and FIG. 8B is a schematic view of a backlight value of an input image according to FIG. 8A. In FIG. 8A and FIG. 8B, the input image is divided into 8 areas (that is, 8 dynamic backlight areas), so as to exhibit an arrangement manner 4×2, so as to facilitate following exemplary description, but the present invention is not limited thereby. As shown in FIG. 8A, the areas A, B, C, and D all have two colors, that is, a pure color (the pure color herein refers to that the saturation degree S is larger than 0.9) and a white color, and meanwhile, the first backlight value BL_first of each area shown in FIG. 8B is used, for example, the first backlight values BL_first of the area A, the area B, and the area C are all 100, and the first backlight value BL_first of the area D is 98. In the present embodiment, the white sub-pixel signals in the area B and the area D exceed the critical value (in the example, the critical value is set as 85%), so that the area B and the area D can obtain a backlight adjustment value BL_adj that is smaller than 1 (in the example, the backlight adjustment value is 0.8). Therefore, in the area B and the area D, after the corresponding first backlight value BL_first and the corresponding backlight adjustment value BL_adj are multiplied, the second backlight value BL_second of the area is obtained. In the present embodiment, the backlight values of the area B and the area D are adjusted to be lower, and the critical value and the backlight adjustment value herein can also be other set values, and are not used to limit the present invention. The white sub-pixel signals of the area A and the area C do not exceed the critical value (85%), and therefore, the backlight adjustment values BL_adj corresponding to the area A and the area C are 1, and the second backlight value BL_second obtained after the first backlight value BL_first and the backlight adjustment value BL_adj are multiplied is unchanged. Therefore, from FIG. 8B, it can be understood that the input image (FIG. 8A) is adjusted from the first backlight value BL_first to the second backlight value BL_second.

Figures 9A, 9B:
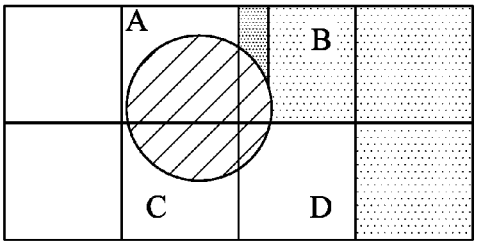
FIG. 9A is a schematic view of another input image according to some embodiments of the present invention.
FIG. 9B is a schematic view of a backlight value of another input image according to FIG. 9A.

For example, referring to FIGS. 9A and 9B, FIG. 9A is a schematic view of another input image according to some embodiments of the present invention and FIG. 9B is a schematic view of a backlight value of an input image according to FIG. 9A. In FIG. 9A and FIG. 9B, the input image is divided into 8 areas (that is, 8 dynamic backlight areas), so as to exhibit an arrangement manner 4×2, so as to facilitate following exemplary description, but the present invention is not limited thereby. As shown in FIGS. 9A and 9B, the areas A, C, and D all have two colors, that is, a pure color and a white color, and meanwhile, the first backlight value BL_first of each area shown in FIG. 9B is used, for example, the first backlight values BL_first of the area A, the area B, and the area C are all 100, and the first backlight value BL_first of the area D is 98. In the present embodiment, the white sub-pixel signal in the area D exceeds the critical value (in the example, the critical value is 85%), so that the area D can obtain a backlight adjustment value BL_adj that is smaller than 1 (in the example, the backlight adjustment value is 0.8). Therefore, in the area D, after the corresponding first backlight value BL_first and the corresponding backlight adjustment value BL_adj are multiplied, the second backlight value BL_second of the area is obtained, that is, the second backlight value BL_second of the area D is 78 (98×0.8=78). In the present embodiment, the backlight value of the area D is adjusted to be lower. The area B has three colors, that is, a pure color, a black color, and a white color, and the white ratio is reduced and does not reach the critical value, and therefore, the corresponding backlight adjustment value BL_adj is 1. Therefore, the second backlight value BL_second obtained after the first backlight value BL_first and the backlight adjustment value BL_adj are multiplied is unchanged. Therefore, from FIG. 9B, it can be understood that the input image (FIG. 9A) is adjusted from the first backlight value BL_first to the second backlight value BL_second.

After the calculation in Step S330, since the backlight values of some dynamic backlight areas are decreased, the power saving effects are achieved.

Figure 10:
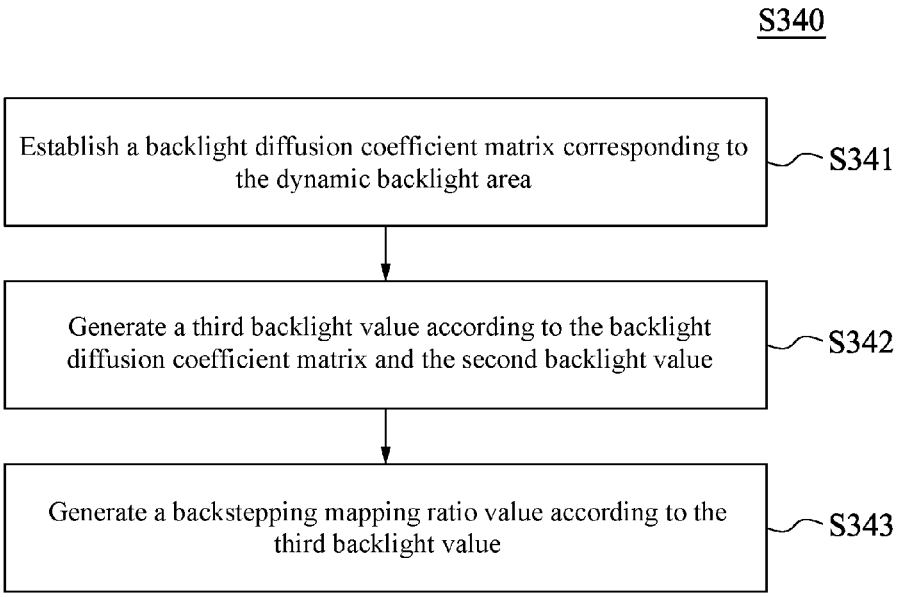
FIG. 10 is a flow chart of Step S340 according to some embodiments of the present invention.

In Step S340, the second backlight value is used to perform backlight diffusion analysis. Referring to FIG. 10, FIG. 10 is a flow chart of step S340 according to some embodiments of the present invention. As shown in FIG. 10, Step S340 comprises the following steps:

Step S341: establishing a backlight diffusion coefficient matrix corresponding to the dynamic backlight area 201;

Step S342: generating a third backlight value according to the backlight diffusion coefficient matrix and the second backlight value; and Step S343: generating a backstepping mapping ratio value α' according to the third backlight value.

In the present embodiment, a light emitting diode is taken as an example of a backlight light emitting module. The LED backlight module has a luminance diffusion phenomenon in different backlight ranges. Therefore, a backlight diffusion coefficient (BLdiffusion) needs to be used again to correct the minimum mapping ratio value $\alpha_{min}$, so that the RGBW signal can have a better display effect with the help of the backlight luminance. If the correction of backlight diffusion is not performed on the RGBW signal, an image distortion phenomenon will occur on a junction of a dark area and a bright area.

Figure 11:
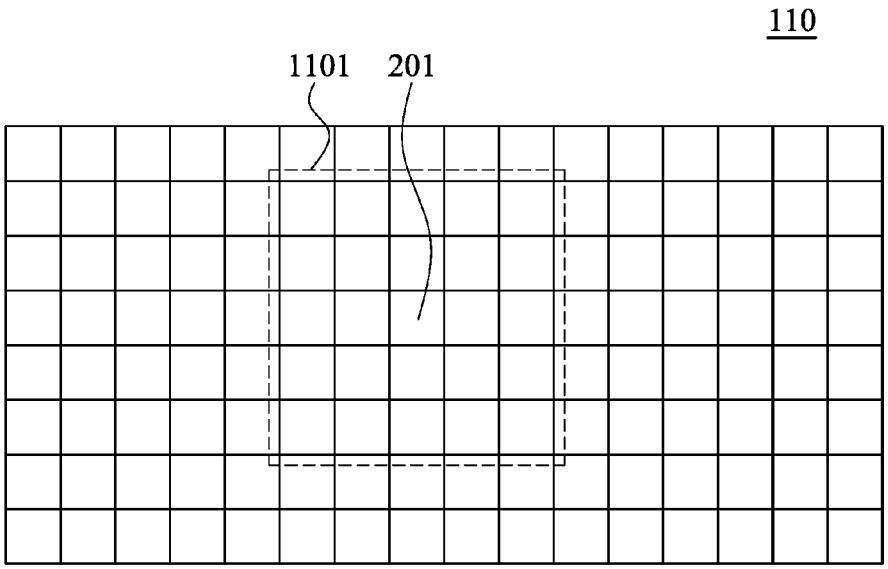
FIG. 11 is a schematic view of a backlight module according to some embodiments of the present invention.

In Step S341, a backlight diffusion coefficient matrix corresponding to the dynamic backlight area 201 is established, and before the backlight diffusion coefficient matrix is established, the dynamic backlight of each area needs to be measured, and a certain area is lightened independently to observe a backlight diffusion phenomenon. Referring to FIG. 11, FIG. 11 is a schematic view of a backlight module 110 according to some embodiments of the present invention, wherein each grid is deemed as a dynamic backlight area 201. As shown in FIG. 11, after the dynamic backlight area 201 in the center of the first area 1101 is lightened, the luminance of 24 adjacent dynamic backlight areas 201 further needs to be measure (as shown by the range of the dotted lines). The ratio of the luminance of the 24 dynamic backlight areas 201 to the luminance of the dynamic backlight area 201 in the center represents the phenomenon of the backlight diffusion of the first area 1101, and the luminance percentages of the 25 dynamic backlight areas 201 can establish a 5*5 backlight diffusion coefficient matrix (as shown in Table 1). The dynamic backlight area 201 in the center of the first area 1101 is the central position of the backlight diffusion coefficient matrix (that is, 100%), after being multiplied with the second backlight value BL_second of the dynamic backlight area 201 that is calculated in the above steps, the ratio of the luminance diffused to the 24 adjacent dynamic backlight areas 201 can be known. All the dynamic backlight areas 201 are calculated according to the method to obtain the actual luminance of each dynamic backlight area 201 after the backlight diffusion is considered.

TABLE 1

| backlight diffusion coefficient matrix | | | | |
|---|---|---|---|---|
| 10% | 15% | 21% | 15% | 10% |
| 12% | 28% | 52% | 27% | 12% |
| 13% | 41% | 100% | 39% | 13% |
| 12% | 34% | 61% | 32% | 12% |
| 10% | 15% | 21% | 15% | 10% |

In Step S342, after the actual luminance of each dynamic backlight area 201 after the backlight diffusion is considered is obtained, regularized calculation is then performed. Then, the dynamic backlight areas 201 in the center are interpolated to 8 adjacent dynamic backlight areas 201 to obtain a simulated status of the backlight luminance of adjacent areas, that is, the third backlight value BL_third. For example, the second backlight value BL_second (only 25 dynamic backlight areas 201 are taken as an example) in Table 2, the second backlight values BL_second of the 25 dynamic backlight areas 201 in Table 2 are all multiplied with the backlight diffusion coefficient matrix in Table 1, and the sum of the products is the result shown in Table 3. Then, regularized calculation is performed, the regularized calculation is calculating the regularized ratio N, and then, the backlight value in Table 3 after the backlight diffusion is considered is divided by N to obtain the regularized backlight value, the regularized ratio N can be obtained by dividing the maximum value (401 herein) of the luminance value in Table 3 after the backlight diffusion is considered by the maximum value (100 herein) of the second backlight value BL_second in Table 2, that is, N=410/100≈4, and the regularized backlight value is shown in Table 4. After the regularized backlight value of each dynamic backlight area 201 is obtained, the regularized backlight value of the dynamic backlight area 201 is interpolated to obtain the backlight value of each pixel point between the two adjacent dynamic backlight area 201, that is, the third backlight value BL_third.

TABLE 2

| the second backlight value | | | | |
|---|---|---|---|---|
| 49 | 80 | 41 | 17 | 0 |
| 83 | 92 | 100 | 32 | 0 |
| 50 | 61 | 100 | 50 | 10 |
| 50 | 50 | 50 | 81 | 4 |
| 50 | 50 | 89 | 84 | 0 |

TABLE 3

| the regularized backlight values after the backlight diffusion is considered | | | | |
|---|---|---|---|---|
| 236 | 300 | 266 | 164 | 113 |
| 287 | 373 | 366 | 247 | 176 |
| 277 | 374 | 401 | 317 | 244 |
| 260 | 356 | 392 | 356 | 278 |
| 256 | 354 | 401 | 355 | 270 |

TABLE 4

| regularized backlight values | | | | |
|---|---|---|---|---|
| 59 | 75 | 66 | 41 | 28 |
| 72 | 93 | 92 | 62 | 44 |
| 69 | 93 | 100 | 79 | 61 |
| 65 | 89 | 98 | 89 | 69 |
| 64 | 89 | 100 | 89 | 68 |

In Step S343, a reciprocal of the third backlight value BL_third of each pixel point is calculated to obtain the backstepping mapping ratio value α' of the RGB first luminance value corresponding to each pixel.

Figure 12:
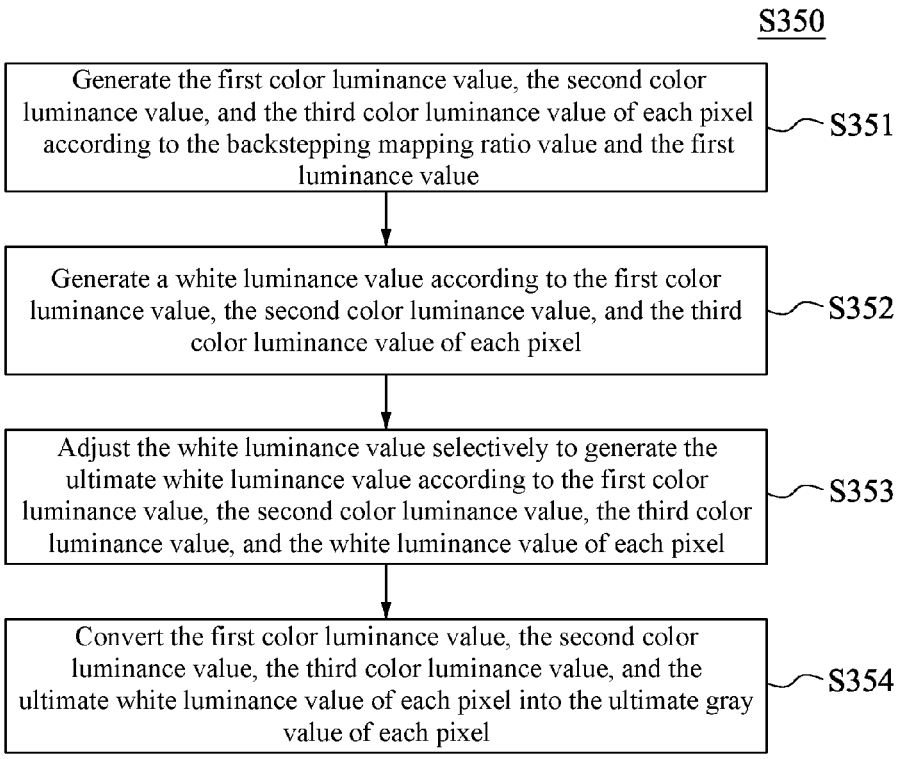
FIG. 12 is a flow chart of step S350 according to some embodiments of the present invention.

In step S350, according to the backstepping mapping ratio value α' and the RGB first luminance value [Rf, Gf, Bf], the ultimate gray value of each pixel of the whole image is calculated. Referring to FIG. 12, FIG. 12 is a flow chart of step S350 according to some embodiments of the present invention. As shown in FIG. 12, Step S350 comprises the following steps:

Step S351: generating the first color luminance value, the second color luminance value, and the third color luminance value of each pixel according to the backstepping mapping ratio value α' and the first luminance value;

Step S352: generating a white luminance value according to the first color luminance value, the second color luminance value, and the third color luminance value of each pixel;

Step S353: adjusting the white luminance value selectively to generate the ultimate white luminance value according to the first color luminance value, the second color luminance value, the third color luminance value, and the white luminance value of each pixel; and Step S354: converting the first color luminance value, the second color luminance value, the third color luminance value, and the ultimate white luminance value of each pixel into the ultimate gray value of each pixel.

In Step S351, the red luminance value (Rout), the green luminance value (Gout), and the blue luminance value (Bout) are obtained according to Formula 10, Rin, Gin, and Bin in Formula 10 are the luminance values of each colors in the RGB first luminance value [Rf, Gf, Bf], and the RGB first luminance value [Rf, Gf, Bf] is generated through the calculation of Step S321, Formula 10 is described as follows:

$$Rout=\alpha'\times Rin,\ Gout=\alpha'\times Gin,\ Bout=\alpha'\times Bin \qquad \text{Formula 10}$$

In step S352, the first white luminance value (Win) is obtained according to Formula 11, wherein is the minimum color luminance value in the RGB first luminance value, and β is a magnification value determined by a backlight signal, and Formula 11 is described as follows:

$$Win = \beta\times\frac{[Rin,\ Gin,\ Bin]_{min}}{2},\ 1\le\beta\le 10. \qquad \text{Formula 11}$$

In Step S353, Formula 10 is used to obtain a red luminance value (Rout), a green luminance value (Gout), and a blue luminance value (Bout), and the second white luminance value (Wadd) is obtained according to Formula 12, and Formula 12 is described as follows:

$$Wadd=0.3\times Rout+0.6\times Gout+0.1\times Bout \quad \text{Formula 12}$$

In Step S354, referring to the second white luminance value (Wadd) obtained above, the ultimate white luminance value (Wout) is calculated according to Formula 13. When the second white luminance value (Wadd) is smaller than 0.7, it represents that there are more pure colors, and therefore, the white luminance value does not need to be enhanced, and when the second white luminance value (Wadd) is larger than or equal to 0.7, the ultimate white luminance value (Wout) is enhanced, and meanwhile, if the value of a is adjusted to be larger (for example, a=0.75), the obtained ultimate white luminance value (Wout) is also increased. Therefore, the effect of detail enhancement can be obtained, and Formula 13 is described as follows:

$$\begin{cases} Wadd \le 0.7, & Wadd = 0 \\ Wadd > 0.7, & Wadd = 1 \end{cases} \quad \text{Formula 13}$$

$$Wout = Win + Wadd * a$$

$$0.25 \le a \le 0.75.$$

In Step S354, the red luminance value (Rout), the green luminance value (Gout), and the blue luminance value (Bout), and the ultimate white luminance value (Wout) are converted into the ultimate gray values by using the conversion between the signal domain and the luminance domain of Formula 1, that is, the conversion from an RGB signal to an RGBW signal is finished.

After the calculation in Step S350, the effects of optimizing visual effects and enhancing the white sub-pixel signal are obtained. In an embodiment, as shown in FIG. 1, after the processor finishes the aforementioned steps, the processed pixel signal is output to the backlight module 110 and the liquid crystal unit 120, thereby controlling the backlight module 110 and the liquid crystal unit 120.

Figure 13:
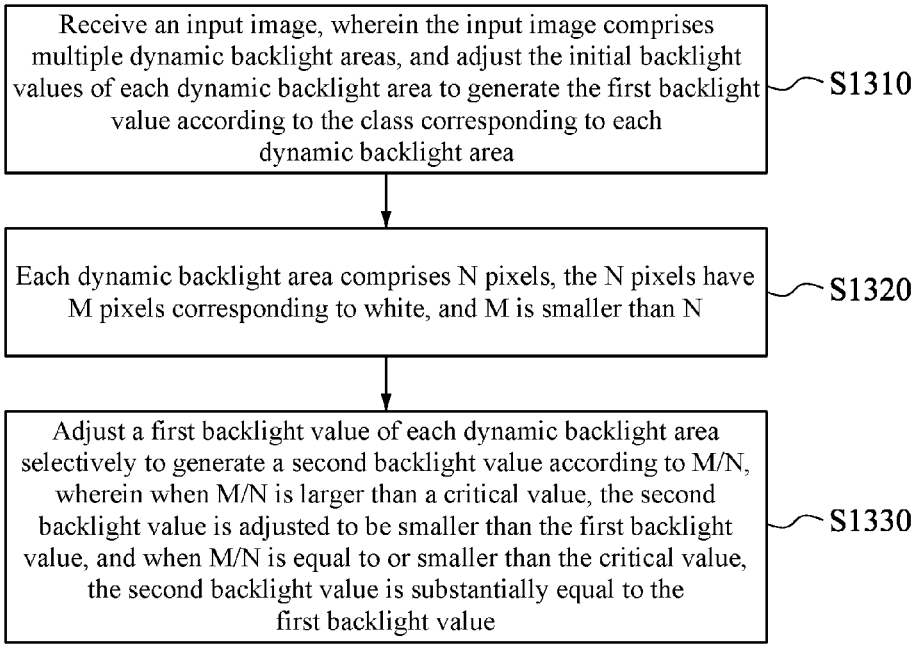
FIG. 13 is a flow chart of a signal processing method according to some embodiments of the present invention.

Then, the signal processing method 1300 in the second embodiment is illustrated. In order to make the signal processing method 1300 be comprehensible, referring to FIG. 2-FIG. 13, FIG. 13 is a flow chart of a signal processing method 1300 according to some embodiments of the present invention. As shown in FIG. 13, the signal processing method 1300 comprises the following steps:

Step S1310: receiving an input image, wherein the input image comprises multiple dynamic backlight areas 201, and adjusting the initial backlight values of each dynamic backlight area 201 to generate the first backlight value according to the class corresponding to each dynamic backlight area 201;

Step S1320: each dynamic backlight area 201 comprises N pixels, N is a positive integer, the N pixels have M pixels corresponding to white, and M is a positive integer and is smaller than N; and Step S1330: adjusting a first backlight value of each dynamic backlight area 201 selectively to generate a second backlight value according to M/N, wherein when M/N is larger than a critical value, the second backlight value is adjusted to be smaller than the first backlight value, and when M/N is equal to or smaller than the critical value, the second backlight value is substantially equal to the first backlight value.

In Step S1310, please refer to Steps S310-S320 for the method for adjusting the initial backlight value of each dynamic backlight area 201. Since the adjustment method is the same, it will not be repeated herein.

In Step S1320 and Step S1330, refer to Step S330 for the method for generating the second backlight value. Next, the method for using the second backlight value to perform backlight diffusion analysis to obtain the backstepping mapping ratio value so as to calculate the ultimate gray value is also the same as Steps S340-S350, and will not be repeated herein. Referring to FIG. 8A and FIG. 8B, the area A and the area B have two colors, that is, a white color and a pure color. It is assumed that the area A and the area B have 100 pixels in total, wherein the area A has 10 pixels that display a white sub-pixel signal, and the area B has 90 pixels that display a white sub-pixel signal. In Step S1330, the ratio of the white sub-pixel signal is determined. Therefore, the ratio of the area A is 1/10 and the ratio of the area B is 9/10. If the critical value is set as 85%, the area B satisfies the determination condition in Step S1330, and the second backlight value is adjusted to be smaller than the first backlight value.

Figure 14A:
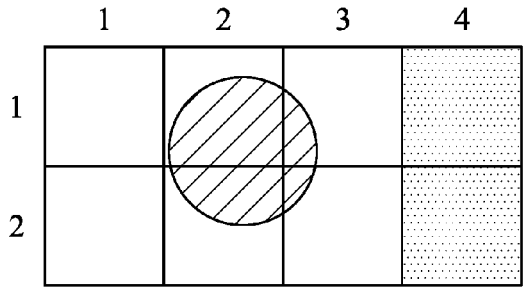
FIG. 14A is a schematic view of an input image according to some embodiments of the present invention.

Then, referring to FIG. 14A, FIG. 14A is a schematic view of an input image according to some embodiments of the present invention. As shown in FIG. 14A, the input image is divided into 8 areas (that is, 8 dynamic backlight areas), the area [X, Y] means the area in the $X_{th}$ row and the $Y_{th}$ column, and each area has 100 pixels. In the present embodiment, the area [1, 1] and the area [2, 1] of the input image are both white images. Therefore, the trichromatic gray values of all the pixels of the area [1, 1] and the area [2, 1] are (255, 255, 255), and the gray values herein are corresponding to the aforementioned initial gray values. After the aforementioned algorithm in the present invention is used, an image with the tetrachromatic gray values is generated, and the tetrachromatic gray values of the area [1, 1] and the area [2, 1] of the output image are adjusted to be (255, 255, 255, 255).

The area [1, 2] and the area [2, 2] of the input image have two colors, that is, the red color and the white color, the trichromatic gray value of the red color is (245, 10, 3), and the trichromatic gray value of the white color is (255, 255, 255). When the proportion of the number of red pixels of the area [1, 2] and the area [2, 2] is larger than 15%, the second backlight value of the area [1, 2] and the area [2, 2] will not be down-regulated in Step S330, and therefore, the obtained mapping ratio value is small (the mapping ratio value is a reciprocal of the second backlight value). Then, in the calculation of Step S351, the obtained trichromatic luminance value is small, and the white luminance value deduced according to the trichromatic luminance value is also small. Therefore, the tetrachromatic gray value of the red color of the area [1, 2] and the area [2, 2] of the output image is (245, 10, 2, 2) and the tetrachromatic gray value of the white color is (186, 186, 186, 186).

The area [1, 3] and the area [2, 3] of the input image also have two colors, that is, the red color and the white color, the trichromatic gray value of the red color is (245, 10, 3), and the trichromatic gray value of the white color is (255, 255, 255). When the proportion of the number of red pixels in the area [1, 3] and the area [2, 3] is smaller than 15%, the second backlight value of the areas [1, 2] and [2, 2] will be down-regulated in Step S330. Therefore, the obtained mapping ratio value is larger (the mapping ratio value is the reciprocal of the second backlight value). Then, in the calculation of Step S351, the obtained trichromatic luminance value is large, and the white luminance value deduced according to the trichromatic luminance value is also large. Therefore, the tetrachromatic gray value of the red color of the area [1, 3] and the area [2, 3] of the output image is (255, 2, 0, 0) and the tetrachromatic gray value of the white color is (208, 208, 208, 235). Compared with the results of the red tetrachromatic gray value and the white tetrachromatic gray value of the area [1, 2] and the area [2, 2], the adjustment range of the red tetrachromatic gray value and the white tetrachromatic gray value of the area [1, 3] and the area [2, 3] is small. The area [1, 4] and the area [2, 4] of the input image are both black images. Therefore, the trichromatic gray value of the area [1, 4] and the area [2, 4] is (0, 0, 0), and the tetrachromatic gray value of the area [1, 4] and the area [2, 4] of the output image is (0, 0, 0, 0) (that is, not adjusted).

Figure 14B:
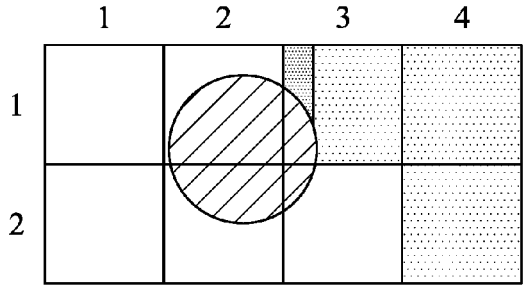
FIG. 14B is a schematic view of another input image according to some embodiments of the present invention.

Referring to FIG. 14B, FIG. 14B is a schematic view of another input image according to some embodiments of the present invention. As shown in FIG. 14B, FIG. 14B and FIG. 14A are different in the color distribution of the area [1, 3], the area [1, 3] of the input image in FIG. 14B has three colors, red, black, and white. The red trichromatic gray value is (245, 10, 3), the black trichromatic gray value is (0, 0, 0), the white trichromatic gray value is (255, 255, 255), and furthermore, the proportion of the number of the red pixels and the number of the black pixels of the area [1, 3] is larger than 15%, the second backlight value of the area [1, 3] will not be down-regulated in Step S330, and therefore, the obtained mapping ratio value is small (the mapping ratio value is the reciprocal of the second backlight value). Then, in the calculation of Step S351, the obtained trichromatic luminance value is small, and the white luminance value deduced according to the trichromatic luminance value is also small. Therefore, the red tetrachromatic gray value of the area [1, 3] of the output image is (245, 10, 2, 2), the black tetrachromatic gray value is (0, 0, 0, 0), and the white tetrachromatic gray value is (186, 186, 186, 186), and the result is the same as the area [1, 2] and the area [2, 2].

According to the embodiments of the present invention, it can be known that, after the influence of the black and the pure colors is eliminated through the saturation degree and the signal luminance information, the proportion of the white signal in each dynamic backlight area can be calculated, when the color with a low saturation degree and high luminance exceeds a certain proportion, the backlight luminance of the dynamic backlight area is down-regulated; then, after the backlight diffusion analysis, a new RGB luminance value is obtained, and the new RGB luminance value is used to determine whether the white signal needs to be enhanced to enhance the luminance of the image. Therefore, the calculation of the present invention can solve the problems of an RGBW LCD, that is, dark state and light leakage, and the white sub-pixel signal is enhanced, and meanwhile, the backlight luminance is dynamically down-regulated, thereby achieving the efficacies of enhancing the image detail display and improving power saving efficiency.

According to the embodiments of the present invention, the embodiment of the present invention provides a display device and a driving method thereof, and in particular, relates to a display device that selects a different driving mode in response to a different load, and a driving method thereof, thereby reducing the power consumption of the display device without reducing the efficiency of the display device.

In addition, the examples comprise sequential exemplary steps. However, the steps do not need to be performed according to the disclosed sequence. Performing the steps in different sequences also falls in the consideration scope of the present disclosure. The sequence can be added, replaced, and changed and/or the steps can be omitted if necessary without departing from the spirit and scope of the embodiments of the present invention.

The present invention is disclosed through the foregoing embodiments; however, these embodiments are not intended to limit the present invention. Various changes and modifications made by persons of ordinary skill in the art without departing from the spirit and scope of the present invention shall fall within the protection scope of the present invention. The protection scope of the present invention is subject to the appended claims.

What is claimed is:

1. A display device, comprising:

a backlight module;

a liquid crystal unit, for displaying an output image; and a processor, coupled to the backlight module and the liquid crystal unit, for receiving an input image and controlling the backlight module and the liquid crystal unit according to the input image;

wherein a plurality of subarea images is defined for the input image and the output image respectively, and each of the subarea images has A pixels;

wherein when a trichromatic gray value of A pixels of a first subarea image of the input image is [255, 255, 255], the A pixels of the first subarea image of the output image have a tetrachromatic gray value [255, 255, 255, 255];

wherein when a trichromatic gray value of B pixels of a second subarea image of the input image is [245, 10, 3], a trichromatic gray value of (A-B) pixels of the second subarea image of the input image is [255, 255, 255], and when a percentage value of B and A is larger than B 15%, a tetrachromatic gray value of the B pixels of the second subarea image of the output image is [245, 10, 2, 2] and a tetrachromatic gray value of the (A-B) pixels of the second subarea image of the output image is [186, 186, 186, 186];

wherein when a trichromatic gray value of C pixels of a third subarea image of the input image is [245, 10, 3], a trichromatic gray value of (A-C) pixels of the third subarea image of the input image is [255, 255, 255], and when a percentage value of C and A is smaller than 15%, a tetrachromatic gray value of the C pixels of the third subarea image of the output image is [255, 2, 0, 0] and a tetrachromatic gray value of the (A-C) pixels of the third subarea image of the output image is [208, 208, 208, 235]; and wherein when a trichromatic gray value of A pixels of a fourth subarea image of the input image is [0, 0, 0], a tetrachromatic gray value of the A pixels of the fourth subarea image of the output image is [0, 0, 0, 0].

2. The display device according to claim 1, wherein when a trichromatic gray value of D pixels of a fifth subarea image of the input image is [245, 10, 3], a trichromatic gray value of E pixels of the fifth subarea image of the input image is [0, 0, 0], a trichromatic gray value of (A-D-E) pixels of the fifth subarea image of the input image is [255, 255, 255], and when a percentage value of D and E is larger than 10%, a tetrachromatic gray value of D pixels of the fifth subarea image of the output image is [245, 10, 2, 2] and a tetrachromatic gray value of the (A-D-E) pixels of the fifth subarea image of the output image is [186, 186, 186, 186].

* * * * *